US009285701B2

(12) United States Patent
Imanaka et al.

(10) Patent No.: US 9,285,701 B2
(45) Date of Patent: Mar. 15, 2016

(54) IMAGE FORMING APPARATUS INCLUDING AN IMAGE CARRIER, A CHARGING MEMBER, A VOLTAGE APPLYING PART, A CURRENT MEASURING PART AND A CONTROLLING PART

(71) Applicant: KYOCERA DOCUMENT SOLUTIONS INC., Osaka (JP)

(72) Inventors: Yoshitaka Imanaka, Osaka (JP); Masahiro Tsutsumi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 108 days.

(21) Appl. No.: 14/049,176

(22) Filed: Oct. 8, 2013

(65) Prior Publication Data

US 2014/0105621 A1 Apr. 17, 2014

(30) Foreign Application Priority Data

Oct. 16, 2012 (JP) ..... 2012-228801
Nov. 19, 2012 (JP) ..... 2012-253252

(51) Int. Cl.
*G03G 15/00* (2006.01)
*G03G 15/02* (2006.01)

(52) U.S. Cl.
CPC ..... *G03G 15/0266* (2013.01)

(58) Field of Classification Search
CPC ..... G03G 15/0266
USPC ..... 399/26, 44, 50, 31, 92, 97
See application file for complete search history.

(56) References Cited

U.S. PATENT DOCUMENTS

| | | | | |
|---|---|---|---|---|
| 7,831,182 | B2 | 11/2010 | Konishi et al. | |
| 2002/0025180 | A1* | 2/2002 | Kimizuka et al. | 399/92 |
| 2006/0291894 | A1* | 12/2006 | Chung et al. | 399/92 |
| 2008/0267641 | A1 | 10/2008 | Konishi et al. | |
| 2012/0148290 | A1* | 6/2012 | Asami | 399/92 |

(Continued)

FOREIGN PATENT DOCUMENTS

| | | | |
|---|---|---|---|
| JP | H08-216660 | A | 8/1996 |
| JP | H09-109653 | A | 4/1997 |

(Continued)

OTHER PUBLICATIONS

English machine translation of JP 2012163741 A.*

(Continued)

*Primary Examiner* — Walter L Lindsay, Jr.
*Assistant Examiner* — Ruth Labombard
(74) *Attorney, Agent, or Firm* — Studebaker & Brackett PC

(57) ABSTRACT

An image forming apparatus includes an image carrier, a charging member, a voltage applying part, a current measuring part and a controlling part. The image carrier carries a toner image. The charging member electrically charges the image carrier. The voltage applying part applies voltage to the charging member. The current measuring part measures current flowing into the charging member. The controlling part controls applied voltage of the voltage applying part. The controlling part decides, when a predetermined voltage is applied to the charging member for a predetermined time by the voltage applying part, if an increase quantity of the current measured by the current measuring part exceeds a predetermined threshold value, that at least one of the image carrier and the charging member is in an abnormal state.

12 Claims, 13 Drawing Sheets

(56) References Cited

U.S. PATENT DOCUMENTS

| | | | | |
|---|---|---|---|---|
| 2014/0140713 | A1* | 5/2014 | Miyaji | 399/44 |
| 2014/0286665 | A1* | 9/2014 | Minagawa et al. | 399/69 |
| 2014/0321868 | A1* | 10/2014 | Tsutsumi | 399/44 |

FOREIGN PATENT DOCUMENTS

| | | | |
|---|---|---|---|
| JP | 2001-194980 | A | 7/2001 |
| JP | 2003-204874 | A | 7/2003 |
| JP | 2003-323100 | A | 11/2003 |
| JP | 2004-013015 | A | 1/2004 |
| JP | 2007-316141 | A | 12/2007 |
| JP | 2008-275725 | A | 11/2008 |
| JP | 2009-265280 | A | 11/2009 |
| JP | 2010-078805 | A | 4/2010 |
| JP | 2012-163741 | A | 8/2012 |
| JP | 2012163741 | A * | 8/2012 |

OTHER PUBLICATIONS

An Office Action; "Notice of Reasons for Rejection," issued by the Japanese Patent Office on Dec. 2, 2014, which corresponds to Japanese Patent Application No. 2012-253252 and is related to U.S. Appl. No. 14/049,176.

An Office Action; "Notice of Reasons for Rejection," issued by the Japanese Patent Office on Oct. 7, 2014, which corresponds to Japanese Patent Application No. 2012-228801 and is related to U.S. Appl. No. 14/049,176.

* cited by examiner

RELATIONSHIP OF ENVIRONMENT TEMPERATURE AND DETECTED TEMPERATURE TO ELAPSED TIME

IMAGE FORMING APPARATUS INCLUDING AN IMAGE CARRIER, A CHARGING MEMBER, A VOLTAGE APPLYING PART, A CURRENT MEASURING PART AND A CONTROLLING PART

INCORPORATION BY REFERENCE

This application is based on and claims the benefit of priority from Japanese Patent application No. 2012-253252 filed on Nov. 19, 2012, and Japanese Patent application No. 2012-228801 filed on Oct. 16, 2012, the entire contents of which are incorporated herein by reference.

BACKGROUND

The present disclosure relates to an electrographic image forming apparatus, such as a printer, a copying machine, a facsimile or a multifunction peripheral.

An electrographic image forming apparatus includes an image carrier (for example, a photosensitive drum) carrying a toner image, a charging member (for example, a charging roller) electrically charging the image carrier, and a exposure device (for example, a LSU (Laser Scanning Unit)) irradiating a laser light to the image carrier. After the image carrier is uniformly electric-charged by the charging member, the laser light corresponding to image data is irradiated to the image carrier by the exposure device, thereby forming an electrostatic latent image to the image carrier.

In the image forming apparatus having such a configuration, in a case where temperature and humidity inside the apparatus become high and other cases, dew condensation may occur on the image carrier. In such a situation in which the dew condensation occurs on the image carrier, if charging of the image carrier by the charging member is attempted, larger current than normality flows between the image carrier and charging member to cause dielectric breakdown, and then, there is a possibility of causing image failure.

By contrast, there is a configuration supplying a toner (a developer) to a surface of the image carrier and removing this toner together with moisture on the surface of the image carrier when the temperature and humidity detected by a temperature and humidity sensor are equal to or more than predetermined values, thereby preventing the dew condensation to the image carrier.

In this configuration, in order to detect abnormality as the dew condensation of the image carrier, the temperature and humidity sensor is a requisite component. However, the temperature and humidity sensor, particularly a humidity sensor, is a relatively expensive part. Therefore, increase in cost is caused and it is difficult to meet request of price reduction of the apparatus. Further, in order to accurately detect temperature difference and humidity difference between the inside and outside of the apparatus by the temperature and humidity sensor, it is necessary to respectively arrange the temperature and humidity sensors to the inside and outside of the apparatus, and accordingly, there is a possibility of causing further increase in cost.

SUMMARY

In accordance with an embodiment of the present disclosure, an image forming apparatus includes an image carrier, a charging member, a voltage applying part, a current measuring part and a controlling part. The image carrier carries a toner image. The charging member electrically charges the image carrier. The voltage applying part applies voltage to the charging member. The current measuring part measures current flowing into the charging member. The controlling part controls applied voltage of the voltage applying part. The controlling part decides, when a predetermined voltage is applied to the charging member for a predetermined time by the voltage applying part, if an increase quantity of the current measured by the current measuring part exceeds a predetermined threshold value, that at least one of the image carrier and the charging member is in an abnormal state.

Moreover, in accordance with an embodiment of the present disclosure, an image forming apparatus includes an image forming part, an apparatus main body, an introducing part, a temperature sensor, a voltage applying part, a current measuring part and a controlling part. The image forming part includes an image carrier and a charging member. The image carrier carries a toner image. The charging member electrically charges the image carrier. The apparatus main body houses the image forming part. The introducing part introduces an air outside the apparatus main body. The temperature sensor is located inside the apparatus main body and arranged so as to detect temperature of an air introduced by the introducing part. The voltage applying part applies voltage to the charging member. The current measuring part measures current flowing into the charging member. The controlling part carrying out the dew condensation avoiding operation in order to avoid the dew condensation of the image forming part under conditions that an increase quantity of the detected temperature of the temperature sensor, when an air outside the apparatus main body is introduced by the introducing part, is equal to or more than a predetermined threshold value and that an increase quantity of the current measured by the current measuring part, when a predetermined voltage is applied to the charging member by the voltage applying part, is equal to or more than a predetermined threshold.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
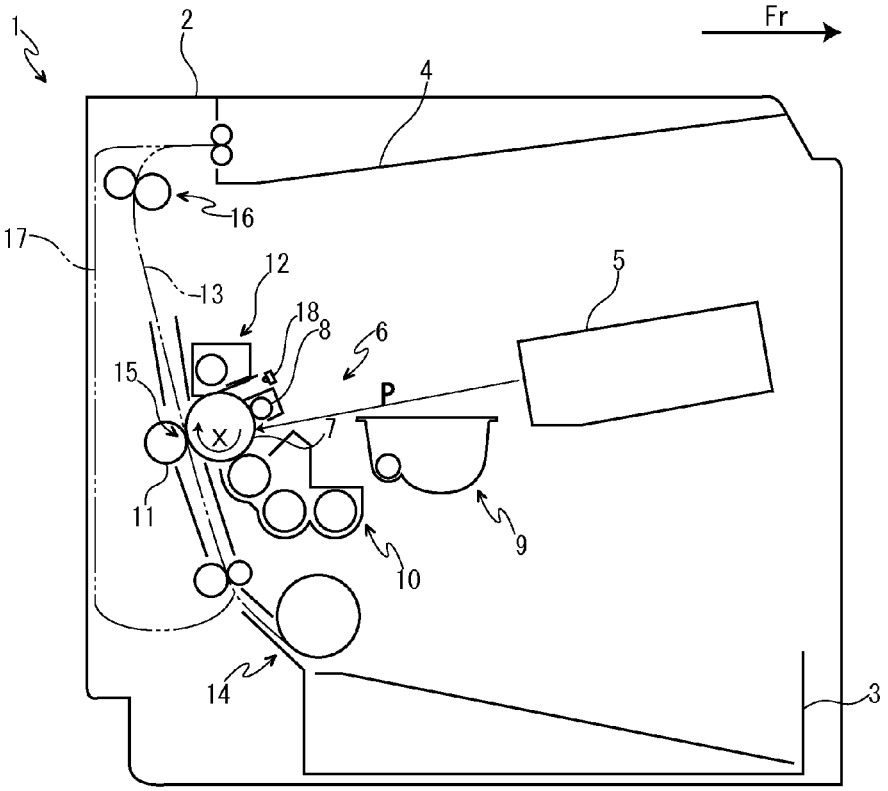
FIG. 1 is a schematic diagram schematically showing a printer according to a first embodiment of the present disclosure.

In the following, a first embodiment will be described. First, with reference to FIG. 1, the structure of a printer 1 as an image forming apparatus will be described. FIG. 1 is a schematic diagram schematically showing the printer according to the first embodiment of the present disclosure. Hereinafter, it will be described so that the front side of the printer 1 is positioned at the right-hand side of FIG. 1. Arrows Fr in FIGS. 1-3 indicate the front side of the printer 1.

The printer 1 includes a printer main body 2 as an apparatus main body. In a lower part of the printer main body 2, a sheet feeding cartridge 3 storing sheets (not shown) is installed and, in a top end of the printer main body 2, a sheet ejecting tray 4 is formed.

In an upper forward part of the printer main body 2, an exposure device 5 composed of a laser scanning unit (LSU) is installed. In a rear part of the printer main body 2, an image forming unit 6 is arranged. In the image forming unit 6, a photosensitive drum 7 as an image carrier is rotatably installed. Around the photosensitive drum 7, a charging roller 8 as a charging member, a development device 10 connected to a toner container 9, a transfer roller 11, a cleaning device 12 and a discharging lamp 18 are located along a rotating direction (refer to an arrow X in FIG. 1) of the photosensitive drum 7.

In the rear part of the printer main body 2, a sheet conveying path 13 is arranged from a lower side to an upper side. At an upstream end in the conveying path 13, a sheet feeder 14 is positioned. At an intermediate stream part in the conveying path 13, a transferring unit 15 composed of the photosensitive drum 7 and transfer roller 11 is positioned. At a downstream part in the conveying path 13, a fixing device 16 as a heat generating part is positioned. In the rear of the conveying path 13, an inversion path 17 for duplex printing is arranged.

Next, the operation of forming an image by the printer 1 having such a configuration will be described.

When the power is supplied to the printer 1, various parameters are initialized and initial determination, such as temperature determination of the fixing device 16, is carried out. Subsequently, in the printer 1, when image data is inputted and a printing start is directed from a computer or the like connected with the printer 1, image forming operation is carried out as follows.

First, the surface of the photosensitive drum 7 is uniformly electric-charged by the charging roller 8. Then, exposure corresponding to the image data on the photosensitive drum 7 is carried out by a laser light (refer to an arrow P in FIG. 1) from the exposure device 5, thereby forming an electrostatic latent image on the surface of the photosensitive drum 7. Subsequently, the development device 10 develops the electrostatic latent image by a toner (a developer) supplied from the toner container 9. Accordingly, a toner image is carried on the photosensitive drum 7.

On the other hand, a sheet fed from the sheet feeding cartridge 3 by the sheet feeder 14 is conveyed to the transferring unit 15 in a suitable timing for the above-mentioned image forming operation, and then, the toner image carried on the photosensitive drum 7 is transferred onto the sheet in the transferring unit 15. The sheet with the transferred toner image is conveyed to a downstream side in the conveying path 13 to go forward to the fixing device 16, and then, the toner image is fixed on the sheet in the fixing device 16. The sheet with the fixed toner image is ejected from a downstream end in the conveying path 13 to the sheet ejecting tray 4. The toner and electrical charge remained on the photosensitive drum 7 is removed by the cleaning device 12 and discharging lamp 18.

Figure 2A:
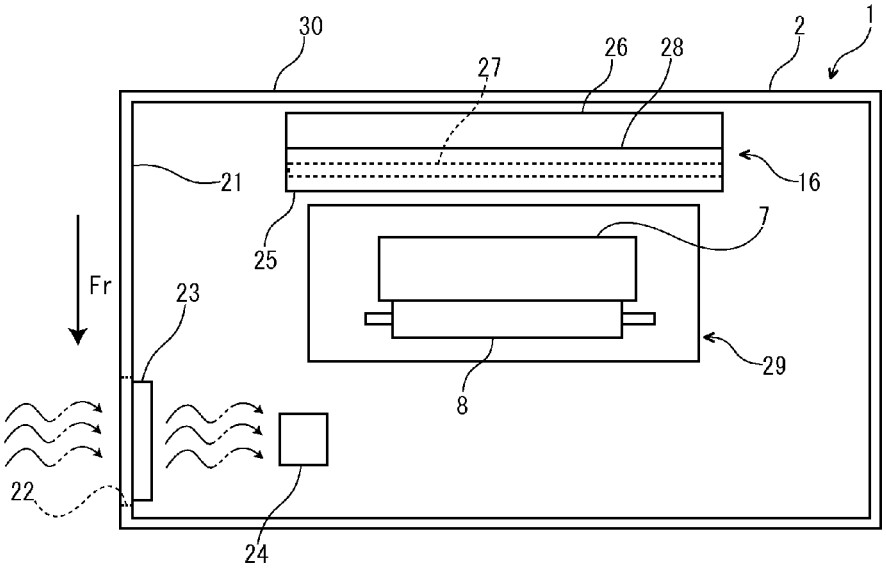
FIG. 2A is a schematic plan view showing the printer in a situation, in which an air outside a printer main body is taken in by a fan, according to the first embodiment of the present disclosure.
Figure 2B:
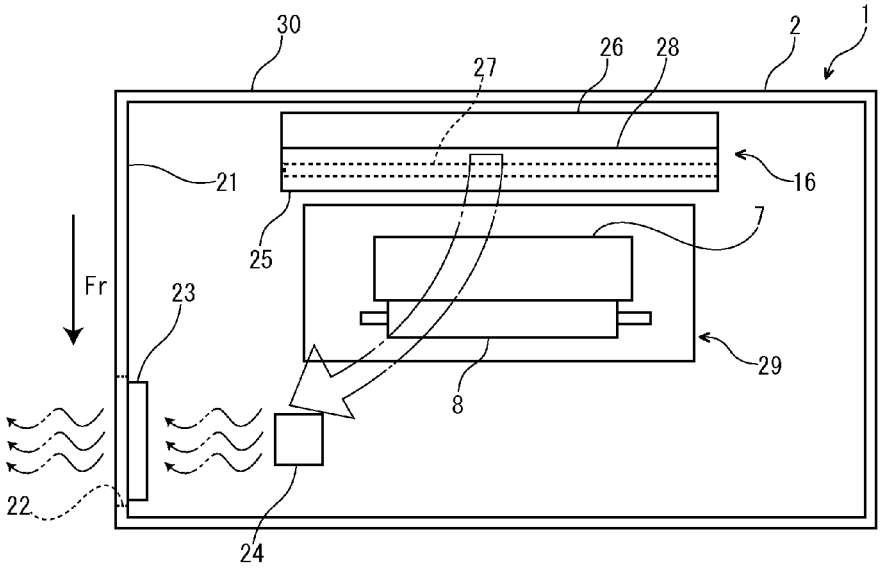
FIG. 2B is another schematic plan view showing the printer in another situation, in which an air inside the printer main body is exhausted by the fan, according to the first embodiment of the present disclosure.

Next, with reference to FIGS. 2A, 2B, 3A and 3B, the printer main body 2, image forming part 6 and fixing device 16 will be described in detail. FIGS. 2A and 2B are schematic plan views showing arrangement of the printer main body 2, photosensitive drum 7, charging roller 8 and fixing device 16 and, except for these components, other components as mentioned above are suitably omitted.

First, the printer main body 2 and its peripheral members will be described. As shown in FIGS. 2A and 2B, the printer main body 2 is formed in a rectangular box-like shape. In a front end of a left cover 21 forming apart of the printer main body 2, a ventilation port 22 composed of a plurality of louvers (not shown) is formed. Inside (at a right side of) the ventilation port 22, a fan 23 is installed. The fan 23 is arranged so as to rotate in forward and reverse directions. The fan 23 is configured to take an air outside the printer main body 2 in the printer main body 2 when rotating in the forward direction (refer to FIG. 2A). The fan 23 is also configured to exhaust an air inside the printer main body 2 outside the printer main body 2 when rotating in the reverse direction (refer to FIG. 2B).

In a left forward part inside the printer main body 2, a temperature sensor 24 is installed. The temperature sensor 24 is located inside (at the right side of) the fan 23. The temperature sensor 24 is composed of, for example, a thermistor.

Figure 3A:
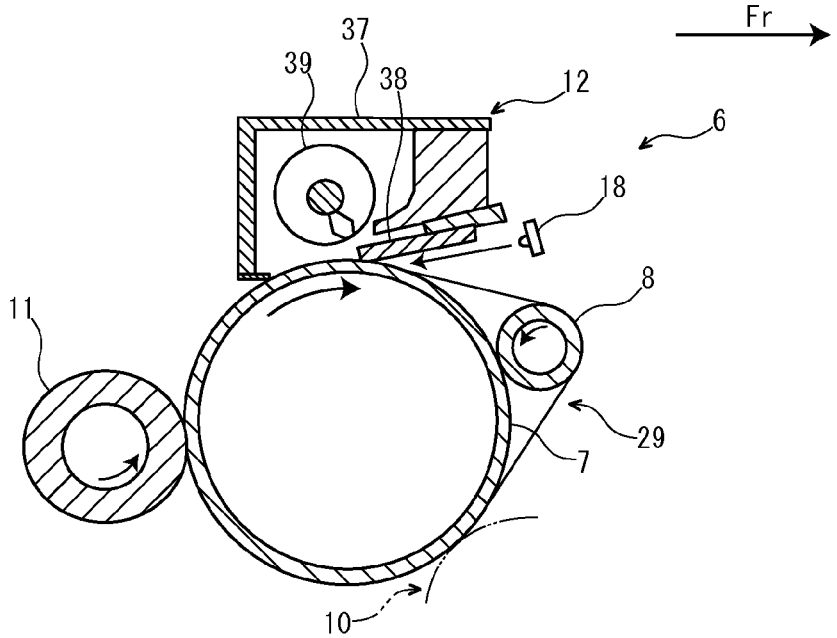
FIG. 3A is a sectional view showing an image forming part of the printer in a situation, in which a photosensitive drum and a charging roller are rotated and an electric-discharging light from a discharging lamp is irradiated to the photosensitive drum, according to the first embodiment of the present disclosure.
Figure 3B:
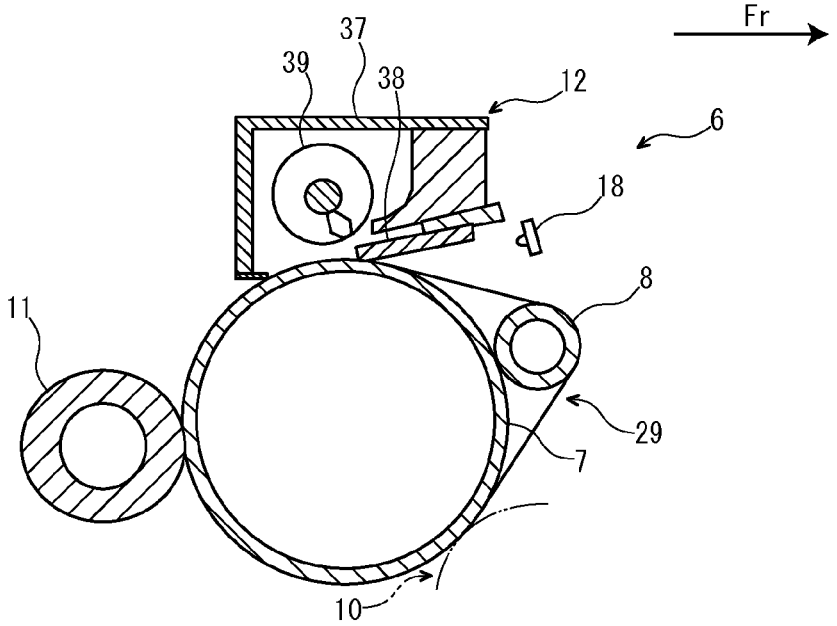
FIG. 3B is another sectional view showing the printer in a situation, in which the rotations of the photosensitive drum and charging roller are stopped and the irradiation of the electric-discharging light from the discharging lamp to the photosensitive drum is stopped, according to the first embodiment of the present disclosure.

Next, the image forming part 6 will be described. As shown in FIGS. 3A and 3B, in the image forming part 6, the photosensitive drum 7 is arranged. The photosensitive drum 7 is formed in an elongated shape in left and right directions and rotatably installed. The photosensitive drum 7 has, for example, a photosensitive layer composed of amorphous silicon (a-Si) or organic photoconductor (OPC). The photosensitive drum 7 is located between the fan 23 and fixing device 16 in a plan view.

In the image forming part 6, the charging roller 8 is located in front of the photosensitive drum 7. The charging roller 8 is formed in an elongated shape in the left and right directions. The charging roller 8 is composed of, for example, a conductive rubber, such as an epichlorohydrin rubber. The charging roller 8 comes into contact with the photosensitive drum 7. The charging roller 8 is integrated with the photosensitive drum 7 to compose a drum unit 29. The drum unit 29 is attachably/detachably attached to the printer main body 2.

In the image forming part 6, the cleaning device 12 is located above the photosensitive drum 7. The cleaning device 12 includes a box-like formed frame member 37, a cleaning blade 38 supported by this frame member 37 and a collecting spiral 39 housed in the frame member 37. The collecting spiral 39 is connected to a toner collecting box (not shown) arranged outside the cleaning device 12. The toner removed from the surface of the photosensitive drum 7 by the cleaning blade 38 is collected by the collecting spiral 39 and conveyed to the toner collecting box.

In the image forming part 6, the discharging lamp 18 is located above and in front of the photosensitive drum 7. The discharging lamp 18 is positioned at an upstream side of the charging roller 8 in the rotating direction of the photosensitive drum 7. The discharging lamp 18 is configured by arranging a plurality of emitting elements (e.g. red LEDs (Light Emitting Diodes)) in a line on a printed circuit board.

In the image forming part 6, although the development device 10 is arranged except for the above-mentioned components, the detailed description of the development device 10 is omitted.

Next, the fixing device 16 will be described. As shown in FIGS. 2A and 2B, the fixing device 16 is located inside (in front of) a rear cover 30 of the printer main body 2 and housed in a rear end part of the printer main body 2. The fixing device 16 includes a heat roller 25 and a press roller 26 located in the rear of the heat roller 25.

The heat roller 25 is formed in an elongated shape in the left and right directions. The heat roller 25 includes, for example, a cylinder-formed core member made of metal, such as aluminum or iron, an elastic layer, which is made of a silicon rubber or the like, installed around this core member, and a release layer, which is made of fluororesin, such as a PFA (Tetra fluoro etylene-Perfluoro alkyl vinyl ether Copolymer), covering this elastic layer. The heat roller 25 is connected to a drive source (not shown), such as a motor, and then, when rotation drive force of the drive source is transmitted to the heat roller 25, the heat roller 25 is rotated. In an internal space of the heat roller 25, a heater 27 composed of, for example, a halogen heater, a ceramic heater or the like is housed.

The press roller 26 is formed in an elongated shape in the left and right directions similarly to the heat roller 25. The press roller 26 includes, for example, a cylinder-formed core member made of metal, such as aluminum or iron, an elastic layer, which is made of a silicon rubber, a silicon sponge or the like, installed around this core member, and a release layer, which is made of fluororesin, such as a PFA (Tetra fluoro etylene-Perfluoro alkyl vinyl ether Copolymer), covering this elastic layer. The press roller 26 is pressed on the heat roller 25 by a bias force of a bias member (not shown), and then, between the heat roller 25 and press roller 26, a fixing nip 28 is formed. When the sheet passes through this fixing nip 28, the toner is fixed on the sheet. The press roller 26 is configured so as to followingly rotate accompanying to the rotation of the heat roller 25 in an opposite direction to the rotation of the heat roller 25.

Figure 4:
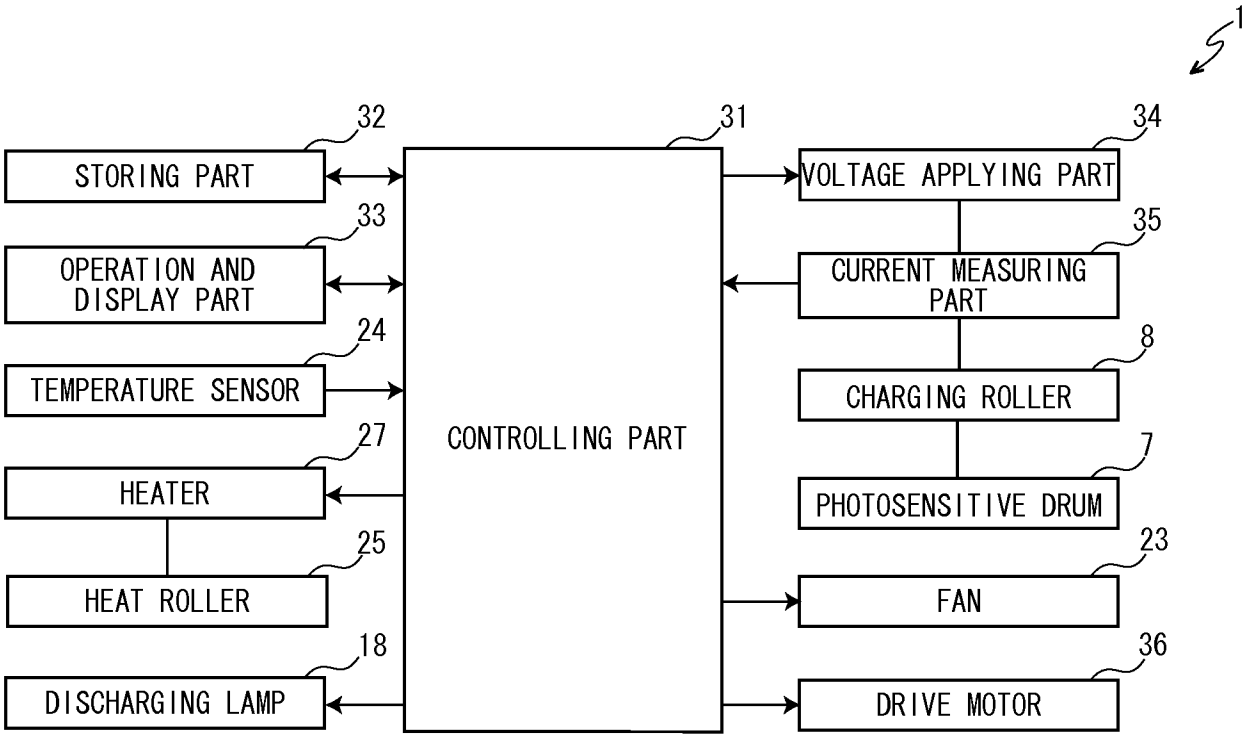
FIG. 4 is a schematic block diagram showing the structure of the printer according to the first embodiment of the present disclosure.

Next, with reference to FIG. 4, a control system of the printer 1 will be described.

The printer 1 includes a controlling part (CPU: Central Processing Unit) 31. The controlling part 31 is connected to a storing part 32 composed of storage devices, such as a ROM (Read Only Memory) and a RAM (Random Access Memory). The controlling part 31 is configured so as to control each component of the printer 1 on the basis of control program and control data stored in the storing part 32. The storing part 32 stores a standard value $I_s$ (2 μA in the first embodiment) of current, a threshold value $I_{th}$ (1 μA in the first embodiment) of an increase quantity of current flowing into the charging roller 8 and a threshold value $T_{th}$ (2° C. in the first embodiment) of an increase quantity of temperature detected by the temperature sensor 24.

The controlling part 31 is connected to an operation and display part 33 arranged to the printer main body 2. The operation and display part 33 includes, for example, operation keys, such as a start key, a stop/clear key, a power key, numeric keys and a touch panel. The operation and display part 33 is configured so as to output the operation instruction to the controlling part 31 according to manipulation of each operation key by a user.

The controlling part 31 is connected to the temperature sensor 24. The temperature detected by the temperature sensor 24 is outputted to the controlling part 31.

The controlling part 31 is connected to the heater 27. The heater 27 is configured so as to be electrically conducted on the basis of a signal from the controlling part 31, and then, to generate heat, and accordingly, to heat the heat roller 25.

The controlling part 31 is connected to the discharging lamp 18. The controlling part 31 is configured so as to control switching between an ON state (a state that the discharging lamp 18 irradiates an electric-discharging light to the photosensitive drum 7) and an OFF state (another state that irradiation of the electric-discharging light from the discharging lamp 18 to the photosensitive drum 7 stops) of the discharging lamp 18.

The controlling part 31 is connected to a voltage applying part (a power source) 34 and the voltage applying part 34 is connected to the charging roller 8. The controlling part 31 is configured so as to control voltage applied from the voltage applying part 34 to the charging roller 8. Between the voltage applying part 34 and charging roller 8, a current measuring part 35 is connected in series. The current measuring part 35 is configured so as to measure a current flowing from the voltage applying part 34 into the charging roller 8 and to output the measured value to the controlling part 31.

The controlling part 31 is connected to the fan 23. The fan 23 is configured to rotate in the forward direction and reverse direction on the basis of a signal from the controlling part 31.

The controlling part 31 is connected to a drive motor (a driving part) 36. The drive motor 36 is connected to the photosensitive drum 7 and charging roller 8. On the basis of a signal from the controlling part 31, the drive motor 36 rotates the photosensitive drum 7 and charging roller 8.

Dew condensation avoidance control of the photosensitive drum 7 in the printer 1 configured as mentioned above will be described mainly with reference to FIG. 5.

First, the controlling part 31 stops the rotations of the photosensitive drum 7 and charging roller 8 and turns the discharging lamp 18 to the OFF state (step S101, refer to FIG.

3B). Next, the controlling part 31 controls the voltage applying part 34 to apply a predetermined voltage (for example, a maximum voltage of 600V in a case where the photosensitive drum 7 is not electrically broken) to the charging roller 8 for two seconds. Accordingly, exciton remained in the photosensitive layer in the photosensitive drum 7 is removed. In addition, the fan 23 is activated and rotated in the forward direction (step S102).

Next, the controlling part 31 decides whether or not a current value $I_1$, which is measured by the current measuring part 35 at a time t1 when two seconds is elapsed after the voltage applying part 34 starts to apply the voltage to the charging roller 8, exceeds the standard value $I_s$ (2 μA) stored in the storing part 32 (step S103). The time t1 is a time when the voltage application from the voltage applying part 34 to the charging roller 8 for two seconds is finished. If the decision result of step S103 is YES, the controlling part 31 decides that the photosensitive drum 7 is in a state that the dew condensation may occur (step S104) and carries out a dew condensation avoiding operation (mentioned as follows in detail) (step S105).

On the other hand, if the decision result of step S103 is NO, the controlling part 31 subtracts the above-mentioned current value $I_1$ from a current value $I_2$, which is measured by the current measuring part 35 at a time t2 when three seconds is elapsed after the voltage applying part 34 starts to apply the voltage to the charging roller 8, thereby calculating an increase quantity ΔI of the current for one second between the time t1 and time t2. The time t2 is a time when one second is elapsed after the voltage application to the charging roller 8 for two seconds by the voltage applying part 34 is finished. Subsequently, the controlling part 31 decides whether or not the above-mentioned quantity ΔI exceeds the threshold value $I_{th}$ (1 μA) stored in the storing part 32 (step S106). If the decision result of step S106 is YES, the controlling part 31 decides that the photosensitive drum 7 is in the state that the dew condensation may occur (step S104) and carries out the dew condensation avoiding operation (mentioned as follows in detail) (step S105).

On the other hand, if the decision result of step S106 is NO, the controlling part 31 subtracts temperature $T_1$, which is detected by the temperature sensor 24 at a time when ten seconds is elapsed after the fan 23 starts to rotate, from temperature $T_2$, which is detected by the temperature sensor 24 at a time when the fan 23 starts to rotate, thereby calculating an increase quantity ΔT of the detected temperature by the temperature sensor 24 for ten seconds as mentioned above. At the time t1, because an air outside the printer main body 2 is not taken in by the fan 23 yet, the temperature $T_1$ is equal to temperature inside the printer main body 2. By contrast, at the time t2, because the air outside the printer main body 2 is taken in by the fan 23 and blown to the temperature sensor 24 (refer to FIG. 2A), the temperature $T_2$ is correspondent to temperature outside the printer main body 2. Therefore, the quantity ΔT calculated by subtracting the temperature $T_1$ from the temperature $T_2$ is correspondent to a temperature difference between the inside and outside of the printer main body 2 (a temperature difference between the inside and outside of the printer 1). The controlling part 31 decides whether or not this quantity ΔT is equal to or more than the threshold value $T_{th}$ (2° C.) stored in the storing part 32 (step S107). If the decision result of step S107 is YES, the controlling part 31 decides that the photosensitive drum 7 is in the state that the dew condensation may occur (step S104) and carries out the dew condensation avoiding operation (mentioned as follows in detail) (step S105). On the other hand, if the decision result of step S107 is NO, the controlling part 31 decides that the photosensitive drum 7 is not in the state that the dew condensation may occur (step S110), and then, finishes the dew condensation avoidance control and returns to an ordinary printing operation.

Next, the above mentioned dew condensation avoiding operation will be described in detail.

The controlling part 31 turns on power of the heater 27 as soon as the controlling part 31 decides that the photosensitive drum 7 is in the state that the dew condensation may occur, and then, the heater 27 heats the heat roller 25. Accompanying to this heating, the press roller 26 pressing on the heat roller 25 is also heated, and accordingly, the entire fixing device 16 generates heat. Moreover, the controlling part 31 activates the fan 23 simultaneously with turning on the power of the heater 27 or after a predetermined time is elapsed from turning on the power of the heater 27 to rotate the fan 23 in the reverse direction. By such a reverse rotation of the fan 23, the air inside the printer main body 2 is exhausted. At that moment, the air is heated by the heat generated in the fixing device 16 and passes through the periphery of the drum unit 29 (refer to FIG. 2B). According to this, the photosensitive drum 7 of the drum unit 29 is heated and the dew condensation of the photosensitive drum. 7 is avoided. The fan 23 is reversely rotated, for example, for 120 seconds, and then, stopped. Accordingly, the dew condensation avoiding operation is finished.

The dew condensation avoiding operation may be carried out once or multiple times optionally determined. Alternatively, for example, the operation may be carried out repeatedly until the current increase quantity measured by the current measuring part 35 or the temperature increase quantity detected by the temperature sensor 24 becomes equal to or less than the predetermined value.

In accordance with the first embodiment, as described above, it is possible to decide whether or not the photosensitive drum 7 is in a state that the dew condensation may occur, without adding relatively expensive component, such as a humidity sensor. Therefore, it is possible to decrease cost and to meet request of price reduction of the apparatus.

In a case of setting a condition that the current $I_1$ or $I_2$ measured by the current measuring part 35 exceeds the predetermined value, if the dew condensation already occurs on the photosensitive drum 7 at a stage of measuring the current flowing into the charging roller 8 by the current measuring part 35, such a situation can be detected. However, in such a configuration, it is impossible to decide a situation in which the dew condensation does not occur on the photosensitive drum 7 yet at a stage of measuring the current flowing into the charging roller 8 by the current measuring part 35, while the dew condensation occurs on the photosensitive drum 7 if the air outside the printer main body 2 is taken in. By contrast, in the first embodiment, not only a decision condition that the value $I_1$ or $I_2$ as the current value exceeds the predetermined threshold value is set, but also another decision condition that the current increase quantity ΔI exceeds the predetermined threshold value are set. Therefore, it is possible to decide not only the situation, in which the dew condensation already occurs on the photosensitive drum 7, but also other situation in which the dew condensation occurs on the photosensitive drum 7 if the air outside the printer main body 2 is taken in, and accordingly, it is possible to accurately decide whether or not the photosensitive drum 7 is in the state that the dew condensation may occur. Thus, "the state that the dew condensation may occur" as a decision subject in the controlling part 31 includes both the situation, in which the dew condensation already occurs on the photosensitive drum 7, and other situation, in which the dew condensation does not occur on the photosensitive drum 7 yet, while the dew condensation occurs on the photosensitive drum 7 if the air outside the printer main body 2 is taken in.

In the first embodiment, the current increase quantity ΔI measured by the current measuring part 35 and the temperature increase quantity ΔT detected by the temperature sensor 24 are combined to decide whether or not the photosensitive drum 7 is in the state that the dew condensation may occur. By applying such a configuration, it is possible to further accurately decide whether or not the photosensitive drum 7 is in the state that the dew condensation may occur, in comparison with a case of setting the current increase quantity ΔI as a standard.

In addition, the temperature sensor 24 arranged inside the printer main body 2 can detect both the temperatures inside and outside the printer main body 2. Therefore, it is possible to decrease the number of the temperature sensors and further decrease the cost, in comparison with a case of arranging the temperature sensors respectively inside and outside the printer main body 2.

If the temperature sensors and humidity sensors were arranged respectively inside and outside the printer main body 2 in order to decide whether or not the photosensitive drum 7 is in the state that the dew condensation may occur, two temperature sensors and two humidity sensors are needed and the cost is increased. By contrast, in the first embodiment, as described above, it is possible to decide by one temperature sensor 24 whether or not the photosensitive drum 7 is in the state that the dew condensation may occur. Therefore, it is possible to decrease one temperature sensor and two humidity sensor, in comparison with a case of using two temperature sensors and two humidity sensors as mentioned above, and accordingly, effect of the cost decrease is heightened.

In the first embodiment, it is possible to prevent image failure accompanying to the dew condensation on the photosensitive drum 7 by carrying out the dew condensation avoiding operation when the controlling part 31 decides that the photosensitive drum 7 is in the state that the dew condensation may occur, and accordingly, an excellent image can be obtained.

In the first embodiment, in the dew condensation avoiding operation, the fan 23 can supply the air heated by the heat generated in the fixing device 16 to the photosensitive drum 7, and accordingly, the photosensitive drum 7 is heated. According to this, it is possible to certainly avoid the dew condensation on the photosensitive drum 7. Particularly, in the first embodiment, because the photosensitive drum 7 is arranged between the fan 23 and fixing device 16 in a plan view, this facilitates the supply of the air heated by the heat generated in the fixing device 16 to the photosensitive drum 7 (refer to a chain line arrow in FIG. 2B). Therefore, effect of avoiding the dew condensation on the photosensitive drum 7 is heightened.

Incidentally, in order to accurately measure the current component caused by the dew condensation on the photosensitive drum 7 among the current flowing into the charging roller 8 when voltage as discharge start voltage or less is applied to the charging roller 8, it is important to make a state that the exciton does not exist in the photosensitive layer of the photosensitive drum 7. As occurrence factors of the above-mentioned exciton, there are friction (a physical occurrence factor) of the cleaning blade 38 and photosensitive drum 7 and the electric-discharging light (an electrical occurrence factor) from the discharging lamp 18.

With regard to this, in the first embodiment, as described above, is a situation of stopping the rotations of the photosensitive drum 7 and charging roller 8 and turning the discharging lamp 18 to the OFF state, the measurement of the current flowing into the charging roller 8 is carried out (refer to FIG. 3B). Therefore, it is possible to prevent both the occurrence of the exciton due to the friction of the cleaning blade 38 and photosensitive drum 7 and the occurrence of the exciton due to the electric-discharging light from the discharging lamp 18. Accordingly, it is possible to make the state that the exciton does not exist in the photosensitive layer of the photosensitive drum 7. According to this, it is possible to accurately measure the current flowing into the charging roller 8 by the current measuring part 35 and to prevent errors from occurring in the decision whether or not the photosensitive drum 7 is in the state that the dew condensation may occur.

In the first embodiment, after the voltage application to the charging roller 8 by the voltage applying part 34 is finished, the current flowing into the charging roller 8 is measured. By applying such a configuration, it is possible to measure the current flowing into the charging roller 8 after the voltage application to the charging roller 8 by the voltage applying part 34 is finished and the exciton in the photosensitive layer of the photosensitive drum 7 is decreased. According to this, it is possible to further accurately measure the current flowing into the charging roller 8 by the current measuring part 35 and to further certainly prevent errors from occurring in the decision whether or not the photosensitive drum 7 is in the state that the dew condensation may occur.

The first embodiment was described about a case, in which the dew condensation avoiding operation is carried out as soon as the controlling part 31 decides that the photosensitive drum 7 is in the state that the dew condensation may occur. On the other hand, in another embodiment, after the controlling part 31 decides that the photosensitive drum 7 is in the state that the dew condensation may occur, an aging operation of rotating the photosensitive drum 7 for a predetermined time (e.g. two minutes) is carried out. Subsequently, in a case, in which the controlling part 31 decides that the photosensitive drum 7 is still kept in the state that the dew condensation may occur even if the aging operation is finished, the dew condensation avoiding operation may be carried out. Further, in such a case, the aging operation and the decision whether or not the photosensitive drum 7 is in the state that the dew condensation may occur are repeated, and then, at a time when the controlling part 31 decides that the photosensitive drum 7 is not in the state that the dew condensation may occur, the operation returns to the ordinary image forming operation. Here, when the controlling part 31 decides that the photosensitive drum 7 is still kept in the state that the dew condensation may occur even if the aging operation is repeated for a predetermined cumulative time (e.g. six minutes), the operation returns to the ordinary image forming operation, the dew condensation avoiding operation may be carried out.

The first embodiment was described about a configuration of avoiding the dew condensation on the photosensitive drum 7 by supplying the air heated by the heat generated in the fixing device 16 to the photosensitive drum 7. On the other hand, in another embodiment, for example, by applying high voltage to the charging roller 8, the dew condensation on the photosensitive drum 7 may be avoided. In a further embodiment, after the toner is supplied from the development device 10 to the photosensitive drum 7 to absorb moisture resulted from the dew condensation on the surface of the photosensitive drum 7 by the toner, by collecting the toner by the cleaning device 12, the dew condensation on the photosensitive drum 7 may be avoided. In addition, the above-mentioned dew condensation avoiding operation may be used at the same time.

Although, in the first embodiment, the temperature sensor 24 is arranged inside the printer main body 2, in another embodiment, if it is difficult to located the fan 23 at a position similar to the first embodiment, the temperature sensors 24 may be arranged inside and outside the printer main body 2.

Although the description in the first embodiment is omitted, the current measuring part 35 also may be used for detecting attachment/detachment of the drum unit 29. In such a case, for example, if the current magnitude measured by the current measuring part 35 is equal to or less than a predetermined value, it is possible to decide that the drum unit 29 is not installed. On the other hand, if the current magnitude measured by the current measuring part 35 exceeds the predetermined value, it is possible to decide that the drum unit 29 is installed.

The first embodiment was described about a case of deciding, when the current increase quantity ΔI measured by the current measuring part 35 exceeds the threshold value $I_{th}$, it decides that the photosensitive drum 7 is in the state that the dew condensation may occur. However, in another embodiment, it may be configured to decide that the photosensitive drum 7 is damaged (for example, the photosensitive drum 7 gets a hole and the current is leaked from the hole), when the current increase quantity ΔI measured by the current measuring part 35 exceeds the threshold value $I_{th}$. That is, an abnormal state of the photosensitive drum 7 is restricted to the state that the dew condensation may occur on the photosensitive drum 7. In a further embodiment, it may be configured to decide that the charging roller 8 is in the abnormal state or to decide that both the photosensitive drum 7 and charging roller 8 are in the abnormal state, when the current increase quantity ΔI measured by the current measuring part 35 exceeds the threshold value $I_{th}$.

Figure 5:
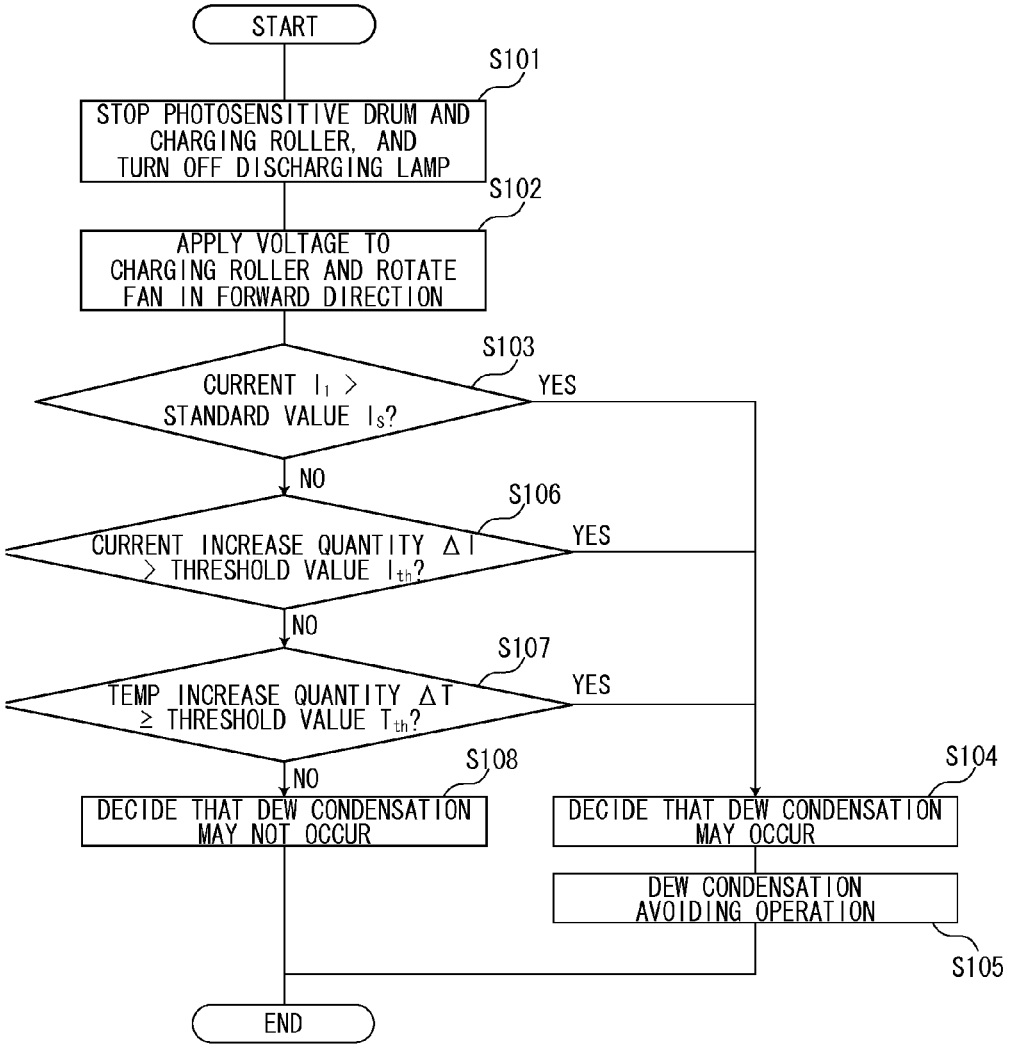
FIG. 5 is a flowchart showing dew condensation avoidance control of the photosensitive drum in the printer according to the first embodiment of the present disclosure.

The first embodiment was described about a case of deciding, when the temperature increase quantity ΔT detected by the temperature sensor 24 is less than the threshold value $T_{th}$, that the photosensitive drum 7 is not in the state that the dew condensation may occur and finishing the dew condensation avoidance control (refer to steps S107 and S108 in FIG. 5). On the other hand, in another embodiment, it is configured to decide that the photosensitive drum 7 is in the abnormal state (for example, the state that the photosensitive drum 7 is damaged) except for the dew condensation, when the temperature increase quantity ΔT detected by the temperature sensor 24 is less than the threshold value $T_{th}$.

Although, in the first embodiment, one threshold value $I_{th}$ and one threshold value $T_{th}$ are determined, in another embodiment, a plurality of threshold values $I_{th}$ and a plurality of threshold values $T_{th}$ may be determined. In such a case, a time to reversely rotate the fan 23 in the dew condensation avoiding operation may be varied according to the plurality of threshold values $I_{th}$ and the plurality of threshold values $T_{th}$.

Although the first embodiment was described about a case of using the charging roller 8 as the charging member, in another embodiment, another charging member formed in another shape, such as a charging blush, may be used.

Although the first embodiment was described about a case of composing the heat generating part of the fixing device 16 having the heater 27 as a heat source, in another embodiment, the heat generating part may be composed of an induction heating type fixing device having an IH coil as the heat source. In a further embodiment, the heat generating part may be composed of another heater arranged at apart except for the fixing device.

The first embodiment was described in a case of applying the configuration of the present disclosure to the printer 1. On the other hand, in another embodiment, the configuration of the disclosure may be applied to another image forming apparatus except the printer 1, such as a copying machine, a facsimile or a multifunction peripheral.

In the following, a second embodiment will be described. Because the configuration of the printer 1 of the second embodiment is similar to the first embodiment, the schematic description of the configuration is omitted. First, with reference to FIGS. 6 and 7, the printer main body 2, image forming part 6 and fixing device 16 will be described. Arrows Fr in FIGS. 6 and 7 indicate the front side of the printer 1.

Figure 6:
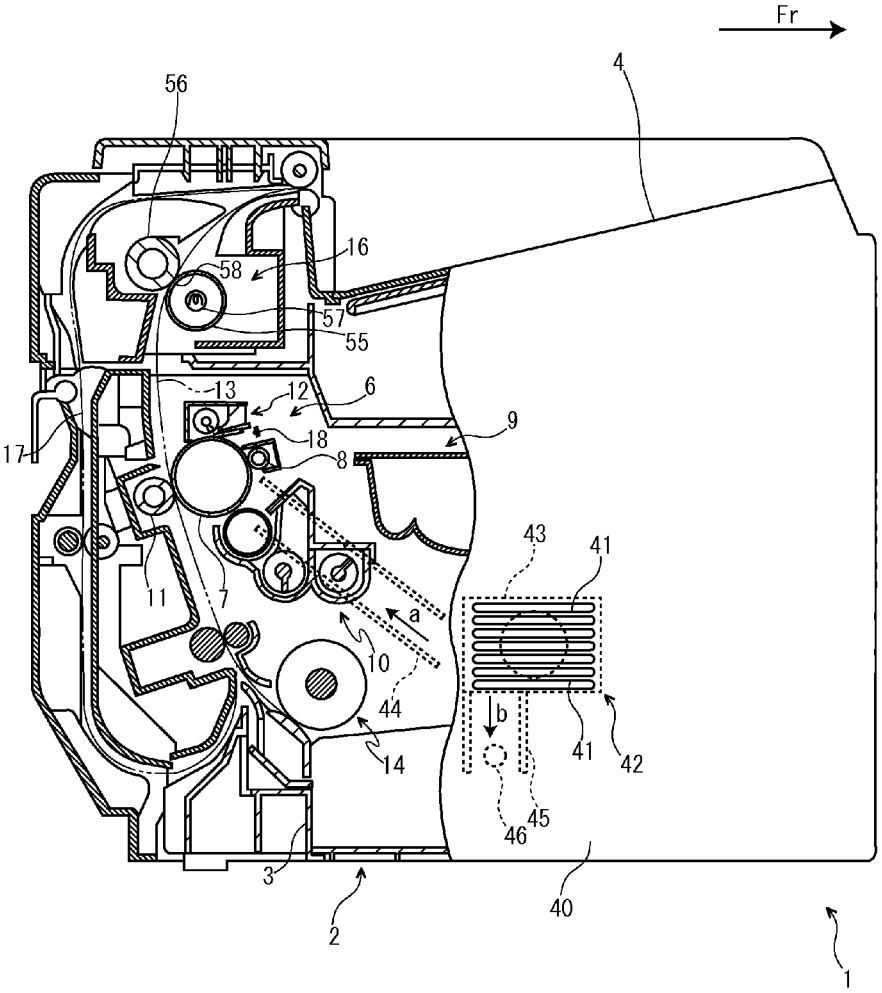
FIG. 6 is a partially cutaway sectional view showing a printer according to a second embodiment of the present disclosure.

First, the printer main body 2 and its peripheral members will be described. As shown in FIG. 6, in a left end part (an end part at a near side in FIG. 6) of the printer main body 2, a left cover 40 is arranged as an external member covering a left end part of the image forming part 6. In FIG. 6, the left cover 40 is illustrated so that a rear part is cut away. In a lower part of the left cover 40, a ventilation port 42 composed of a plurality of louvers is formed.

In the left end part of the printer main body 2, a fan 43 is installed as an introducing part inside (at a right side of) the ventilation port 42. The fan 43 is arranged so as to rotate in forward and reverse directions. The fan 43 is configured to introduce an air outside the printer main body 2 inside the printer main body 2 when rotating in the forward direction. The fan 43 is also configured to exhaust an air inside the printer main body 2 outside the printer main body 2 when rotating in the reverse direction.

Inside the printer main body 2, a first duct 44 extending from the fan 43's side to the image forming part 6's side and a second duct 45 extending from the fan 43's side to a different side (a lower side in the second embodiment) from the image forming part 6's side are arranged. In the second duct 45, a temperature sensor 46 is arranged. The temperature sensor 46 is located at an internal face side (a right face side in the second embodiment) of the left cover 40. The temperature sensor 46 is composed of, for example, the thermistor.

Figure 7:
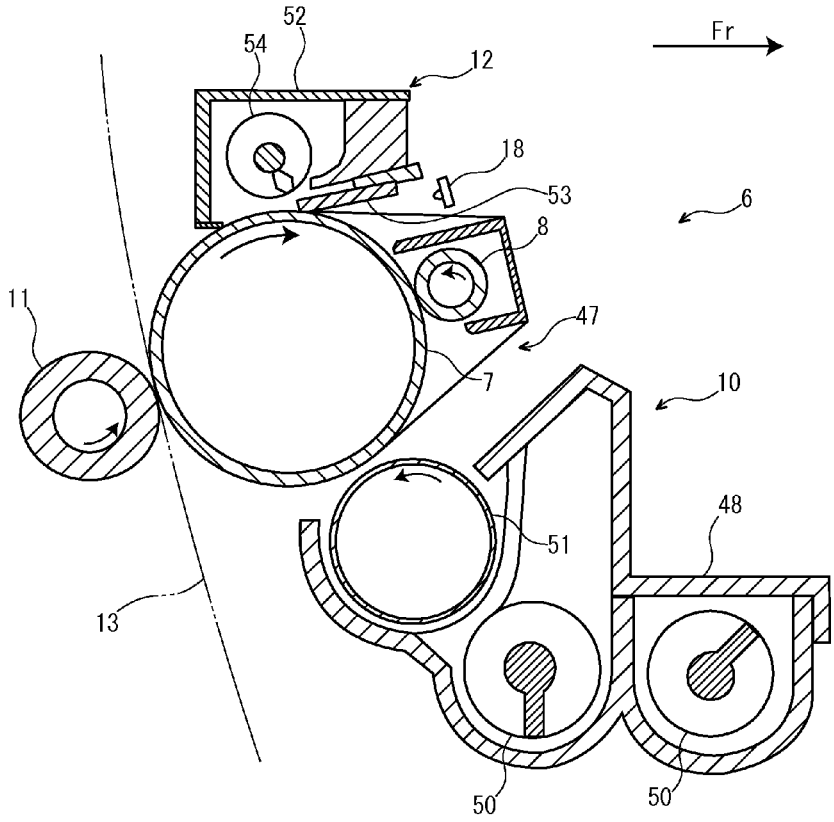
FIG. 7 is a sectional view showing an image forming part in the printer according to the second embodiment of the present disclosure.

Next, the image forming part 6 will be described. The image forming part 6 is housed in the printer main body 2 and located between the fan 43 and fixing device 16 in aside view. As shown in FIG. 7, the image forming part 6 includes the photosensitive drum 7, charging roller 8 located in front of the photosensitive drum 7, development device 10 located at a lower forward side of the photosensitive drum 7, transfer roller 11 located at a left side of the photosensitive drum 7, cleaning device 12 located above the photosensitive drum 7 and discharging lamp 18 located at a upper forward side of the photosensitive drum 7.

The charging roller 8 is arranged close to or comes into contact with the photosensitive drum 7. The charging roller 8 is integrated with the photosensitive drum 7 to compose a drum unit 47.

The development device 10 includes a development device main body 48, a pair of front and rear agitating members 50 housed in the development device main body 48, and a developing roller 51 being located at an upper backward side of the rear agitating member 50 and facing to the photosensitive drum 7.

The transfer roller 11 includes, for example, a core member made of metal, such as stainless steel, and an elastic layer installed around this core member. In the elastic layer, electric conductivity is applied by carbon or the like.

The cleaning device 12 includes a box-like formed frame member 52, a cleaning blade 53 supported by this frame member 52 and a collecting spiral 54 housed in the frame member 52.

The discharging lamp 18 is configured to irradiate the electric-discharging light from each emitting element on the photosensitive drum 7, thereby electrically discharging surface potential of the photosensitive drum 7. In the above-mentioned image forming part 6, a cycle having charging, exposure, development and transfer is repeated.

Next, the fixing device 16 will be described. As shown in FIG. 6, the fixing device 16 is housed in the rear end part of the printer main body 2. The fixing device 16 includes a heat roller 55 and a press roller 56 located at an upper backward side of the heat roller 55.

In an internal space of the heat roller 55, a heater 57 as s heat source composed of, for example, a halogen heater, a ceramic heater or the like is housed. Between the heat roller 55 and press roller 56, a fixing nip 58 is formed.

Figure 8:
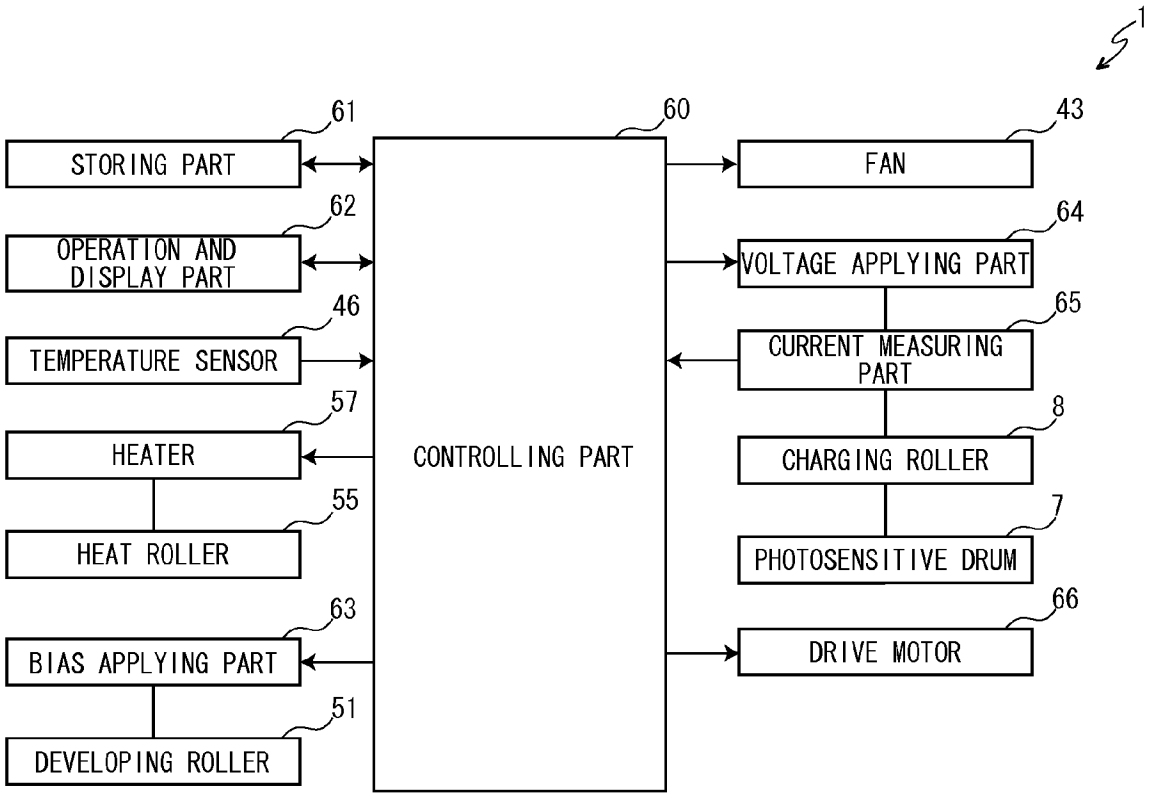
FIG. 8 is a schematic block diagram showing the structure of the printer according to the second embodiment of the present disclosure.

Next, with reference to FIG. 8, a control system of the printer 1 will be described.

The printer 1 includes a controlling part (CPU) 60. The controlling part 60 is connected to a storing part 61 composed of storage devices, such as a ROM and a RAM. The storing part 61 stores standard temperature $T_s$ (15° C. in the second embodiment), a threshold value $T_{th}$ (2° C. in the second embodiment) of an increase quantity of temperature detected by the temperature sensor 46 and a threshold value $I_{th}$ (2 μA in the second embodiment) of an increase quantity of current flowing into the charging roller 8. The controlling part 60 is connected to an operation and display part 62 arranged to the printer main body 2. The controlling part 60 is connected to the temperature sensor 46. The controlling part 60 is connected to the heater 57. The heater 57 is configured so as to be electrically conducted on the basis of a signal from the controlling part 60, and then, to generate heat, and accordingly, to heat the heat roller 55.

The controlling part 60 is connected to a bias applying part 63 and the bias applying part 63 is connected to the developing roller 51. The controlling part 60 is configured so as to control development bias applied from the bias applying part 63 to the developing roller 51.

The controlling part 60 is connected to the fan 43. The fan 43 is configured to rotate in the forward direction and reverse direction on the basis of a signal from the controlling part 60.

The controlling part 60 is connected to a voltage applying part (a power source) 64 and the voltage applying part 64 is connected to the charging roller 8. The controlling part 60 is configured so as to control charging voltage applied from the voltage applying part 64 to the charging roller 8. Between the voltage applying part 64 and charging roller 8, a current measuring part 65 is connected in series. The current measuring part 65 is configured so as to measure a current flowing from the voltage applying part 64 into the charging roller 8 and to output the measured result to the controlling part 60. The current measuring part 65 is composed of, for example, a control circuit board including a sensor measuring a current flowing into the charging roller 8.

The controlling part 60 is connected to a drive motor 66 being as a driving part. The drive motor 66 is connected to rotating members, such as the photosensitive drum 7, charging roller 8, developing roller 51 and heat roller 55. The drive motor 66 is configured to rotate the above-mentioned rotating members on the basis of a signal from the controlling part 66.

In the printer 1 configured as mentioned above, variation of temperature detected by the temperature sensor 46 when the fan 43 is rotated will be described.

In a state that the fan 43 is stopped, the temperature sensor 46 detects the temperature inside the printer main body 2. Even if the temperature outside the printer main body 2 suddenly varies in the state that the fan 43 is stopped, because the left cover 40 demarcates the temperature sensor 46 and the outside of the printer main body 2, the detected temperature of the temperature 46 does not suddenly vary.

On the other hand, for example, when the fan 43 is rotated in the forward direction as an auxiliary drive for the image forming operation, the air outside the printer main body 2 is introduced by the fan 43. A part of the air introduced from the outside of the printer main body 2 is send to the first duct 44, and then, passes through the first duct 44 and comes into contact with the image forming part 6 (refer to an arrow a in FIG. 6). Another part of the air introduced from the outside of the printer main body 2 is send to the second duct 45, and then, comes into contact with the temperature sensor 46 in the second duct 45 (refer to an arrow b in FIG. 6).

In this way, when the air introduced from the outside of the printer main body 2 comes into contact with the temperature sensor 46, the temperature outside the printer main body 2 is detected by the temperature sensor 46 and the detected temperature of the temperature sensor 46 varies according to the temperature outside the printer main body 2. For example, in a case where the temperature outside the printer main body 2 is higher than the temperature inside the printer main body 2, when the air introduced from the outside of the printer main body 2 comes into contact with the temperature sensor 46, the detected temperature of the temperature sensor 46 increases. The increase quantity of the detected temperature is larger, as the temperature outside the printer main body 2 is higher in comparison with the temperature inside the printer main body 2. Therefore, by the increase quantity of the detected temperature of the temperature sensor 46, a temperature difference between the outside and inside of the printer main body 2 can be grasped.

Figure 9:
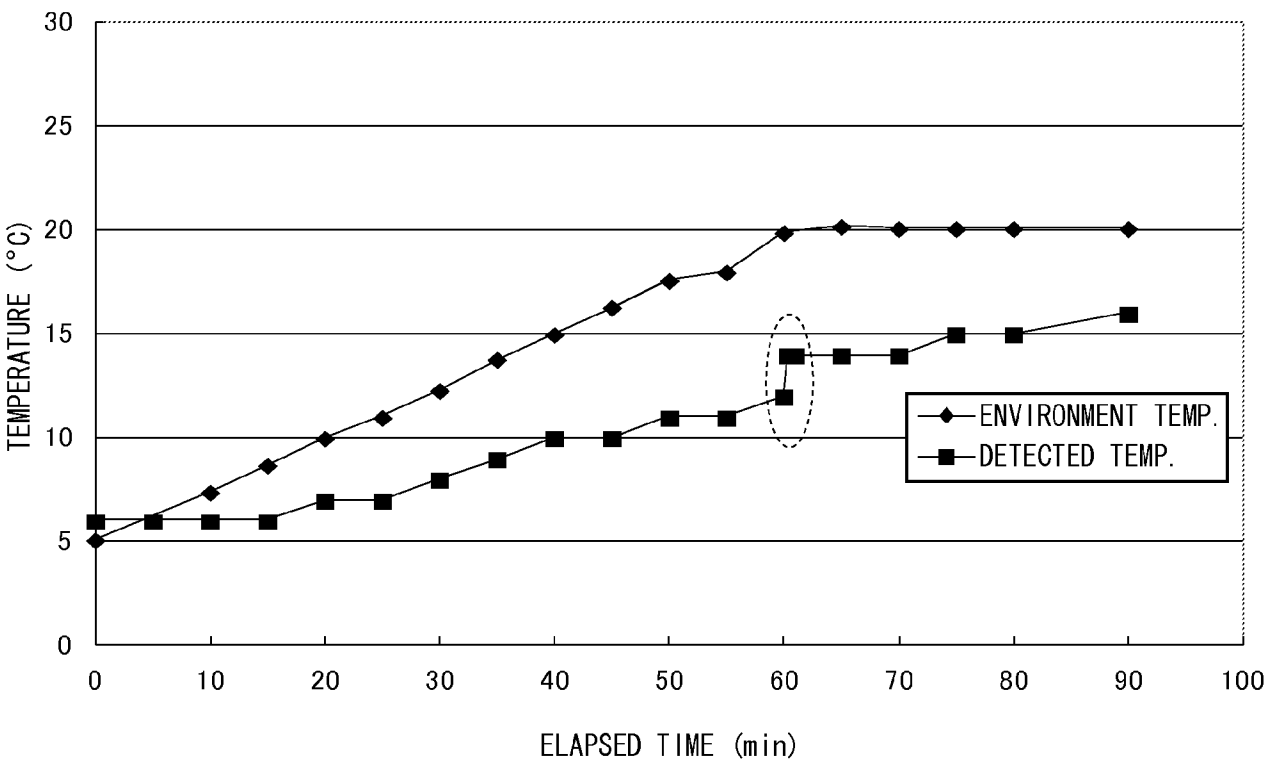
FIG. 9 is a graph showing relationship of environmental temperature and detected temperature to an elapsed time in the printer according to the second embodiment of the present disclosure.

For example, FIG. 9 shows a situation in which, when environment temperature (temperature around the printer 1) increases from 5° C. to 20° C., accompanying to this, the detected temperature of the temperature sensor 46 is increasing. In this example, when the elapsed time is sixty minutes, the fan 43 is rotated in the forward direction for ten seconds. According to this, the air introduced from the outside of the printer main body 2 comes into contact with the temperature sensor 46, the detected temperature of the temperature sensor 46 suddenly increases (refer to a part encircled by a broken line in FIG. 9). As a result, it is possible to grasp that the temperature outside the printer main body 2 is higher than the temperature inside the printer main body 2.

Figure 10:
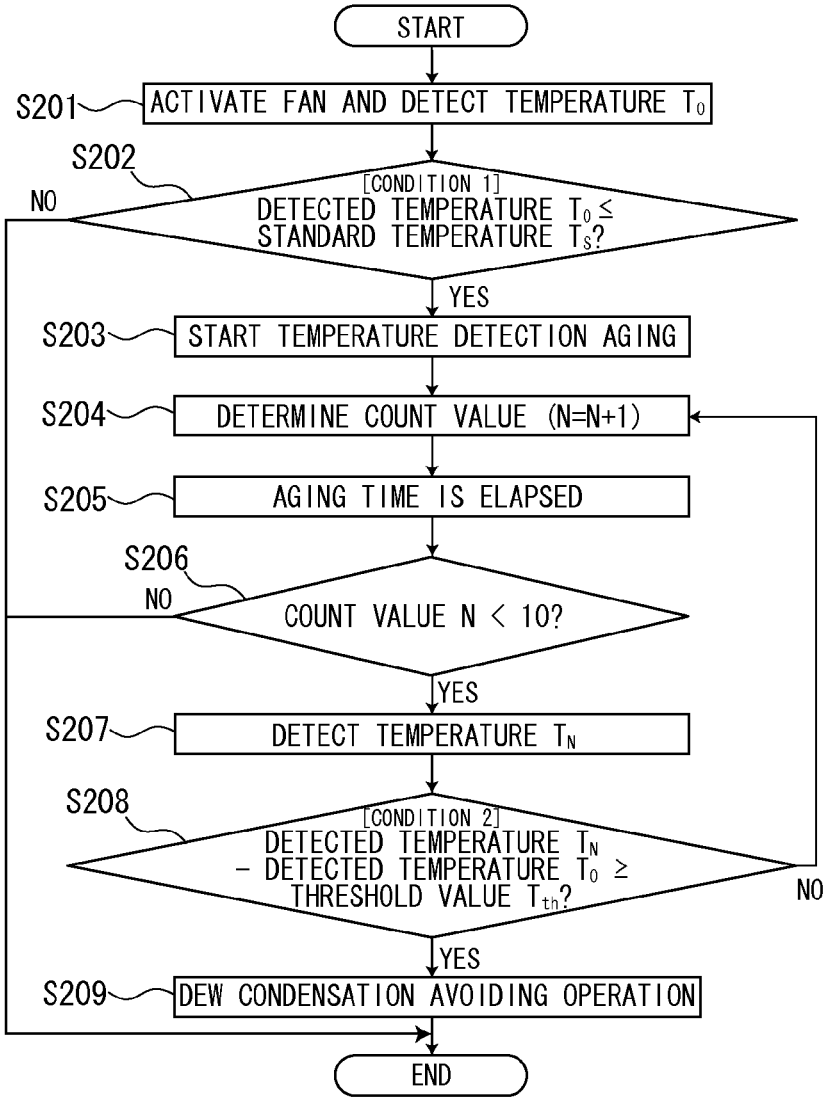
FIG. 10 is a flowchart showing a first execution example (a comparative example) of dew condensation avoidance control in the printer according to the second embodiment of the present disclosure.

Next, in the printer 1 configured as mentioned above, a method of carrying out the dew condensation avoidance control of the image forming part 6 in a case supplying the power to the printer 1, a case of opening or closing a cover (not shown), or a case of returning from a sleep mode to a printing mode or other cases will be described. First, a first execution example (a comparative example) of the dew condensation avoidance control will be described mainly with reference to FIG. 10.

First, the fan 43 is activated to start the introduction of the air outside the printer main body 2 and the temperature sensor 46 carries out the temperature detection. A time at this moment is determined as a value t0 and the detected temperature of the temperature sensor 46 at the time t0 is determined as a value $T_0$ (step S201).

Subsequently, the controlling part 60 decides whether or not the detected temperature $T_0$ of the temperature sensor 46 at the time t0 is equal to or less than the standard temperature $T_s$ (15° C.) stored in the storing part 61 (step S202). If the decision result of step S202 is NO, the controlling part 60 decides that the image forming part 6 is not in the state that the dew condensation may occur and finishes the dew condensation avoidance control.

On the other hand, if the decision result of step S202 is YES, the controlling part 60 starts temperature detection aging (step S203). This temperature detection aging firstly adds one to a count value N (an integer initially set to zero), that is, the count value N is determined by a numerical expression of N=N+1 (step S204), and then, waits until an aging time (two seconds in the second embodiment) is elapsed (step S205). Subsequently, the controlling part 60 decides whether or not the count value N is less than ten (step S206).

If the decision result of step S206 is NO, the controlling part 60 decides that the image forming part 6 is not in the state that the dew condensation may occur and finishes the dew condensation avoidance control. On the other hand, if the decision result of step S206 is YES, the controlling part 60 controls the temperature sensor 46 to detect the detected temperature $T_N$ corresponding to the count value N (step S207).

Subsequently, the controlling part 60 subtracts the detected temperature $T_0$ from the detected temperature $T_N$, thereby calculating an increase quantity of the detected temperature of the temperature sensor 46 from the time t0 to a time when the count value N is obtained, and then, decides whether or not the increase quantity is equal to or more than the threshold value $T_{th}$ (2° C.) stored in the storing part 61 (step S208). If the temperature outside the printer main body 2 is higher than the temperature inside the printer main body 2 by a predetermined value, the decision result of step S208 becomes YES. Alternatively, if the temperature outside the printer main body 2 is not higher than the temperature inside the printer main body 2 by a predetermined value, the decision result of step S208 becomes NO.

If the decision result of step S208 is NO, the controlling part 60 returns to step S204 to add one to the count value N by the numerical expression of N=N+1. On the other hand, if the decision result of step S208 is YES, the controlling part 60 decides that the image forming part 6 is in the state that the dew condensation may occur and carries out the dew condensation avoiding operation (mentioned as follows in detail) (step S209).

The controlling part 60 finishes the dew condensation avoidance control when the dew condensation avoiding operation is completed. When the dew condensation avoidance control is finished, the controlling part 60 carries out the image forming operation or waits in a state (a Ready state) being capable of the image forming operation of at any time.

As described above, in the first execution example of the dew condensation avoidance control, under one condition that the increase quantity of the detected temperature of the temperature sensor 46 when the air outside the printer main body 2 is introduced by the fan 23 is equal to or more than the threshold value $T_{th}$, the controlling part 60 carries out the dew condensation avoiding operation in order to avoid the dew condensation in the image forming part 6. By applying such a configuration, it is possible to prevent the dew condensation in the image forming part 6 from causing leak breakdown of the photosensitive drum 7 without arranging the temperature sensor 46 outside the printer main body 2. Therefore, it is possible to decrease the number of the temperature sensor 46 and its accessory parts and to decrease the cost.

In addition, the temperature sensor 46 is located in the second duct 45 arranged from the fan 43' side toward a predetermined direction (a downward direction in the second embodiment). Therefore, in the dew condensation avoidance control, the air introduced by the fan 43 can be guided to the temperature sensor 46 by the second duct 45 and certainly brought into contact with the temperature sensor 46. According to this, it is possible to further heighten accuracy of the dew condensation detection.

Moreover, the temperature sensor 46 is located at the internal face side of the left cover 40. Therefore, because the outside of the printer main body 2 and temperature sensor 46 are demarcated by the left cover 40, it is possible to prevent the air outside the printer main body 2 from coming into contact with the temperature sensor 46 before introducing the air outside the printer main body 2 by the fan 43. Accordingly, it is possible to further heighten the accuracy of the dew condensation detection.

Figure 11:
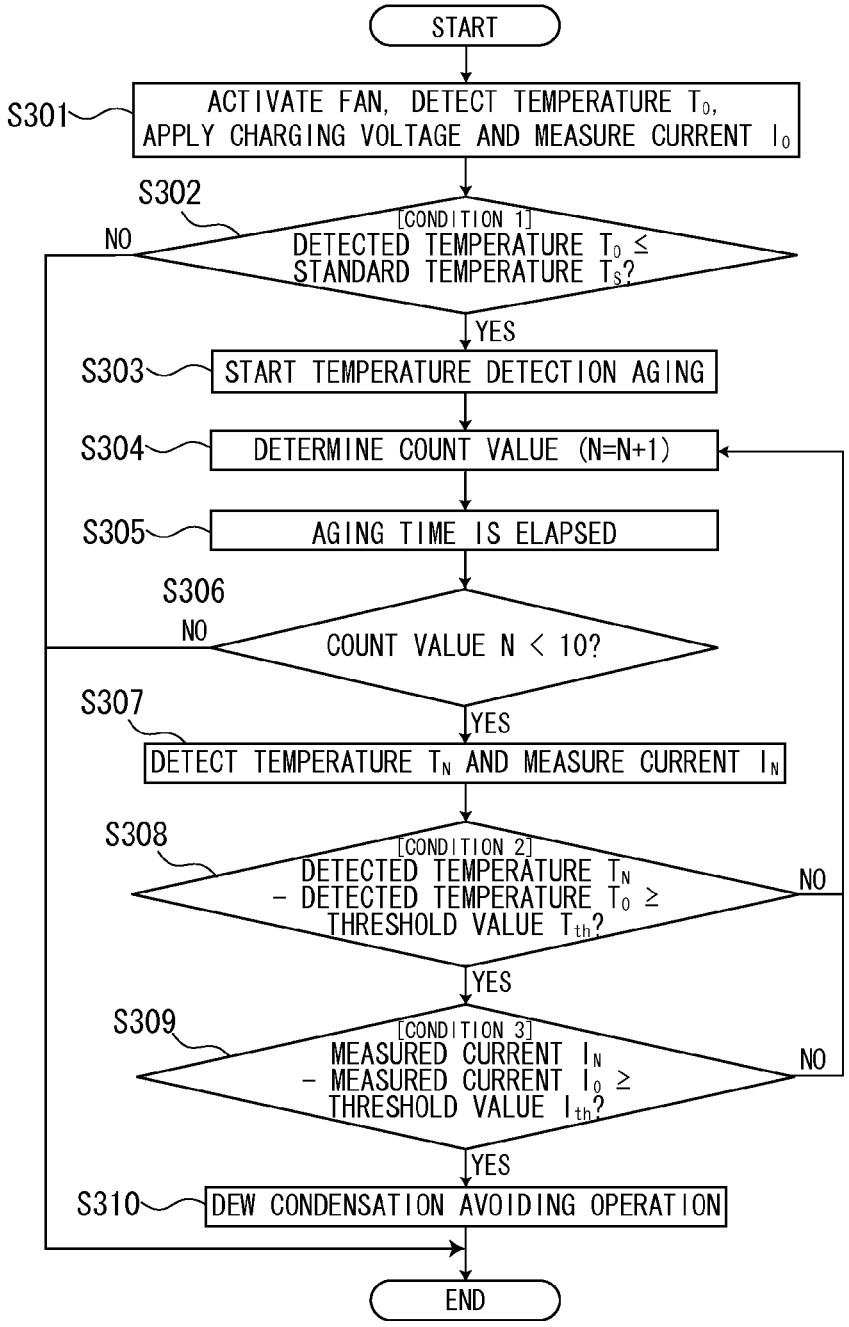
FIG. 11 is a flowchart showing a second execution example (an execution example of the present disclosure) the dew condensation avoidance control in the printer according to the second embodiment of the present disclosure.
Figure 12:
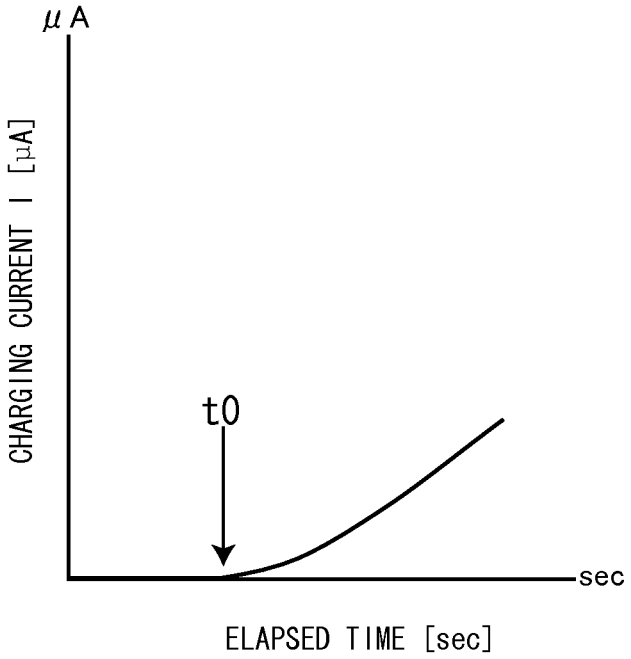
FIG. 12 is a graph showing relationship between an elapsed time and charging current during the dew condensation of the image forming part grows in the printer according to the second embodiment of the present disclosure.

Next, a second execution example (an execution example of the present disclosure) of the dew condensation avoidance control will be described mainly with reference to FIGS. 11 and 12.

First, the fan 43 is activated to start the introduction of the air outside the printer main body 2 and the temperature sensor 46 carries out the temperature detection. In addition, the voltage applying part 64 applies a predetermined voltage to the charging roller 8 and the current measuring part 65 carries out the current measurement. A time at this moment is determined as a value t0, the detected temperature of the temperature sensor 46 at the time t0 is determined as a value $T_0$ and the measured current of the current measuring part 65 at the time t0 is determined as a value $I_0$ (step S301).

Subsequently, the controlling part 60 decides whether or not the detected temperature $T_0$ of the temperature sensor 46 at the time t0 is equal to or less than the standard temperature $T_s$ (15° C.) stored in the storing part 61 (step S302). If the decision result of step S302 is NO, the controlling part 60 decides that the image forming part 6 is not in the state that the dew condensation may occur and finishes the dew condensation avoidance control.

On the other hand, if the decision result of step S302 is YES, the controlling part 60 starts the temperature detection aging (step S303). Because the contents of the steps (steps S304-S306) with regard to the temperature detection aging are similar to the steps (steps S204-S206) with regard to the temperature detection aging of the above-mentioned first execution example, the description of the contents is omitted.

If the decision result of step S306 is NO, the controlling part 60 decides that the image forming part 6 is not in the state that the dew condensation may occur and finishes the dew condensation avoidance control. On the other hand, if the decision result of step S306 is YES, the temperature sensor 46 detects the detected temperature $T_N$ corresponding to the count value N and the current measuring part 65 measures the measured current $I_N$ corresponding to the count value N (step S307). Subsequently, the controlling part 60 subtracts the detected temperature $T_0$ from the detected temperature $T_N$, thereby calculating an increase quantity of the detected temperature of the temperature sensor 46 from the time t0 to a time when the count value N is obtained, and then, decides whether or not the increase quantity is equal to or more than the threshold value $T_{th}$ (2° C.) stored in the storing part 61 (step S308). If the decision result of step S308 is NO, the controlling part 60 returns to step S304 to add one to the count value N by the numerical expression of N=N+1.

On the other hand, if the decision result of step S308 is YES, the controlling part 60 subtracts the measured current $I_0$ from the measured current $I_N$, thereby calculating an increase quantity of the measured current of the current measuring part 65 from the time t0 to a time when the count value N is obtained, and then, decides whether or not the increase quantity is equal to or more than the threshold value $I_{th}$ (2 μA) stored in the storing part 61 (step S309). If the dew condensation in the image forming part 6 (particularly, the photosensitive drum 7 and charging roller 8) grows from the time t0 (the time when the fan 43 is activated), because the current flowing into the charging roller 8 increases (refer FIG. 12), the decision result of step S309 becomes YES. Alternatively, if the dew condensation in the image forming part 6 does not grow from the time t0, because the current flowing into the charging roller 8 does not vary, the decision result of step S309 becomes NO.

If the decision result of step S309 is NO, the controlling part 60 returns to step S304 to add one to the count value N by the numerical expression of N=N+1. On the other hand, if the decision result of step S309 is YES, the controlling part 60 decides that the image forming part 6 is in the state that the dew condensation may occur and carries out the dew condensation avoiding operation (mentioned as follows in detail) (step S310).

The controlling part 60 finishes the dew condensation avoidance control when the dew condensation avoiding operation is completed. When the dew condensation avoidance control is finished, the controlling part 60 carries out the image forming operation or waits in the state (the Ready state) being capable of the image forming operation of at any time.

As described above, in the second execution example of the dew condensation avoidance control, under a condition that the increase quantity of the detected temperature of the temperature sensor 46 when the air outside the printer main body 2 is introduced by the fan 23 is equal to or more than the threshold value $T_{th}$ and that the increase quantity of the measured current of the current measuring part 65 when the predetermined voltage is applied to the charging roller 8 by the voltage applying part 64 is equal to or more than the threshold value $I_{th}$, the dew condensation avoiding operation is carried out. By applying such a configuration, in comparison with a case of setting the increase quantity of the detected temperature of the temperature sensor 46 as the standard (refer to the first execution example of the dew condensation avoidance control), it is possible to further accurately decide whether or not the image forming part 6 is in the state that the dew condensation may occur. For example, in the case of setting the increase quantity of the detected temperature of the temperature sensor 46 as the standard, there is a possibility of carrying out the dew condensation avoiding operation in a low humidity state that the dew condensation does not occur in the image forming part 6. However, by adding the increase quantity of the measured current of the current measuring part 65 as the standard, it is possible to prevent disadvantage due to such a possibility. Moreover, because the accuracy of the dew condensation detection is heightened without using the humidity sensor, it is possible to prevent an increase in cost.

Next, the dew condensation avoiding operation carried out in the above-mentioned dew condensation avoidance control will be described mainly with reference to FIGS. 13A and 13B.

Figure 13A:
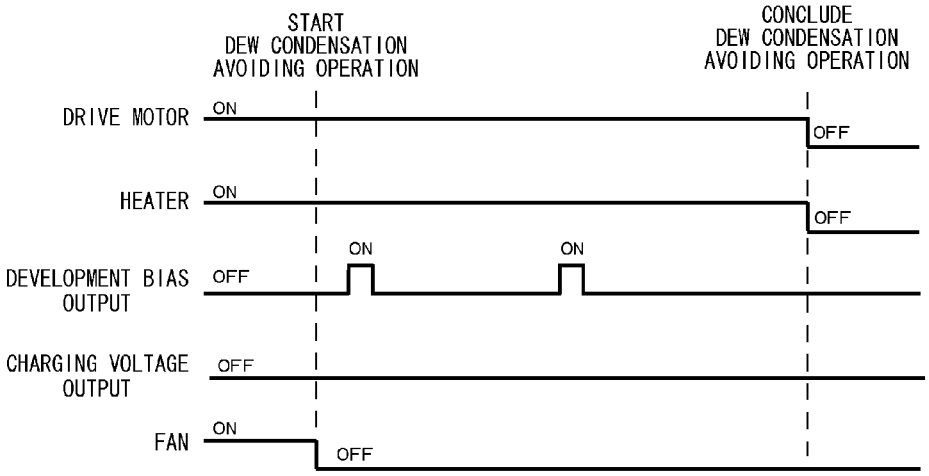
FIG. 13A is a timing chart showing the first practical example of a dew condensation avoiding operation in the printer according to the second embodiment of the present disclosure.

FIG. 13A is a timing chart showing a first practical example of the dew condensation avoiding operation. In the first practical example, during the dew condensation avoiding operation, a drive motor 66 is kept in an ON state and the drive motor 66 rotates the photosensitive drum 7 and charging roller 8. In addition, during the dew condensation avoiding operation, the heater 57 is kept in an ON state and the heater 57 heats the heat roller 55. According to this heating, the press roller 56 pressed on the heat roller 55 is also heated, and then, the entire fixing device 16 generates heat. By applying such a configuration, it is possible to supply the air heated by the heater 57 to the entire area of the photosensitive drum 7 and charging roller 8, and accordingly, to certainly prevent the dew condensation of the photosensitive drum 7 and charging roller 8.

In the first practical example, in a situation of rotating the developing roller 51 by the drive motor 66, the development bias is applied to the photosensitive drum 7 by the bias applying part 63 twice, and accordingly, the toner is supplied to the photosensitive drum 7 by the developing roller 51 twice. After this toner absorbs the moisture on the photosensitive drum 7, the toner is removed from the surface of the photosensitive drum 7 by the cleaning blade 53 and collected to a toner collecting box (not shown) by the collecting spiral 54. By applying such a configuration, it is possible to carry out the dew condensation avoiding operation by using the development device 10 and cleaning device 12 being as existing components, and accordingly, to prevent complication of the configuration.

In the first practical example, during the dew condensation avoiding operation, charging voltage is not applied to the charging roller 8 by the voltage applying part 64, that is, output of the charging voltage is kept in an OFF state. In addition, during the dew condensation avoiding operation, the fan 43 is kept in an OFF state.

Figure 13B:
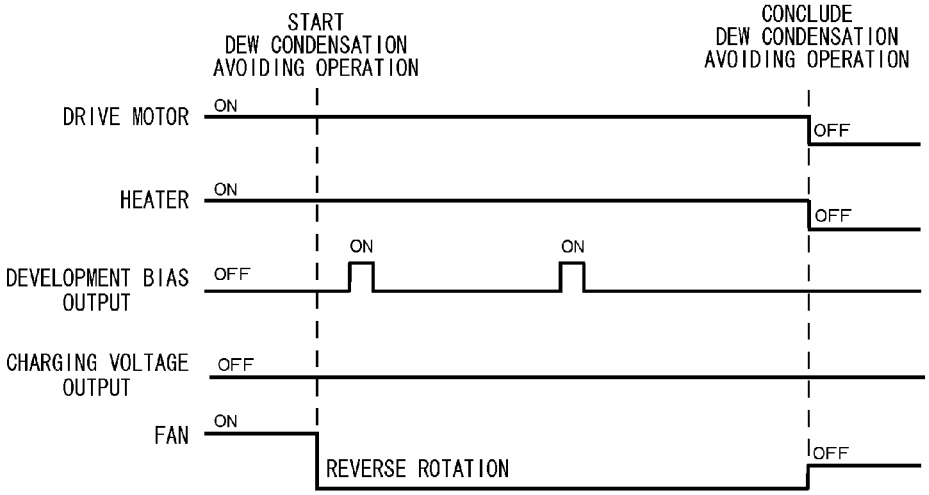
FIG. 13B is a timing chart showing the second practical example of the dew condensation avoiding operation in the printer according to the second embodiment of the present disclosure.

FIG. 13B is a timing chart showing a second practical example of the dew condensation avoiding operation. Although, in the above-mentioned first practical example, the fan 43 is kept in the OFF state when the dew condensation avoiding operation is carried out, in the second practical example, the fan 43 is rotated in an opposite direction to the rotation for introduction of the air outside the printer main body 2. By applying such a configuration, it is possible to effectively supply the air heated by the heater 57 to the image forming part 6, and accordingly, to further certainly prevent the dew condensation of the image forming part 6.

In the above-mentioned first and second practical examples of the dew condensation avoiding operation, the charging voltage is not applied to the charging roller 8 by the voltage applying part 64 when the dew condensation avoiding operation is carried out. However, in another embodiment, high voltage may be applied to the charging roller 8 by the voltage applying part 64 when the dew condensation avoiding operation is carried out.

The second embodiment was described about a case of combining the detected temperature of the temperature sensor 46 and measured current of the current measuring part 65 to carry out the dew condensation detection of the image forming part 6 (refer to the second practical example of the dew condensation avoidance control). On the other hand, in another embodiment, the detected temperature of the temperature sensor 46 and detected humidity of a humidity sensor (not shown) bay be combined to carry out the dew condensation detection of the image forming part 6.

Although, in the second embodiment, one threshold value $I_{th}$ and one threshold value $T_{th}$ are determined, in another embodiment, a plurality of threshold values $I_{th}$ and a plurality of threshold values $T_{th}$ may be determined. In such a case, a time to reversely rotate the fan 23 in the dew condensation avoiding operation may be varied according to the plurality of threshold values $I_{th}$ and the plurality of threshold values $T_{th}$.

Although the second embodiment was described about a case of arranging the temperature sensor 46 in the second duct 45, in another embodiment, in another case of not using the second duct 45, the temperature sensor 46 may be arranged in the first duct 44. In a further embodiment, the temperature sensor 46 may be arranged outside the duct.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an image carrier carrying a toner image;

a charging member electrically charging the image carrier;

a voltage applying part applying voltage to the charging member;

a current measuring part measuring current flowing into the charging member; and a controlling part controlling applied voltage of the voltage applying part and deciding, when a predetermined voltage is applied to the charging member for a predetermined time by the voltage applying part, if an increase quantity of the current measured by the current measuring part exceeds a predetermined threshold value, that at least one of the image carrier and the charging member is in an abnormal state, wherein the image carrier is a rotatably arranged photosensitive drum, and the controlling part controls the photosensitive drum to stop rotating, when the predetermined voltage is applied to the charging member for the predetermined time by the voltage applying part.

2. The image forming apparatus according to claim 1, wherein the controlling part decides, when the predetermined voltage is applied to the charging member for the predetermined time by the voltage applying part, if the increase quantity of the current measured by the current measuring part exceeds the predetermined threshold value, that the image carrier is in a state that dew condensation may occur, and then, carries out a dew condensation avoiding operation in order to avoid the dew condensation of the image carrier.

3. The image forming apparatus according to claim 2 further comprising:

an apparatus main body housing the image carrier and the charging member;

a temperature sensor arranged inside the apparatus main body; and a fan configured to take air from outside the apparatus main body in and to blow the air to the temperature sensor, wherein the controlling part decides that the image carrier is in a state that dew condensation may occur if the increase quantity of the detected temperature of the temperature sensor is equal to or more than a predetermined threshold value within a predetermined time after the fan is activated.

4. The image forming apparatus according to claim 3 further comprising:

a heat generating part housed in the apparatus main body, wherein the controlling part controls the heat generating part to generate heat and controls the fan to rotate in a reverse direction to take in air from outside the apparatus main body, when the dew condensation avoiding operation is carried out.

5. The image forming apparatus according to claim 1, wherein the current measuring part measures the current flowing into the charging member after a voltage application to the charging member by the voltage applying part is finished.

6. An image forming apparatus comprising:

an image forming part including an image carrier carrying a toner image and a charging member electrically charging the image carrier;

an apparatus main body housing the image forming part;

an introducing part introducing air from outside the apparatus main body;

a temperature sensor located inside the apparatus main body and arranged so as to detect a temperature of air introduced by the introducing part;

a voltage applying part applying voltage to the charging member;

a current measuring part measuring current flowing into the charging member; and a controlling part carrying out a dew condensation avoiding operation in order to avoid a dew condensation of the image forming part under conditions that an increase quantity of the detected temperature of the temperature sensor, when air from outside the apparatus main body is introduced by the introducing part, is equal to or more than a first predetermined threshold value and that an increase quantity of the current measured by the current measuring part, when a predetermined voltage is applied to the charging member by the voltage applying part, is equal to or more than a second predetermined threshold value, wherein inside the apparatus main body, a first duct extending upward from an introducing part's side of the apparatus main body where the introducing part is located to an image forming part's side of the apparatus main body where the image forming part is located and a second duct extending downward from the introducing part's side to a side of the apparatus main body, which is different from the image forming part's side are arranged, and the temperature sensor is arranged in the second duct, and an external member is arranged in a horizontal end part of the apparatus main body, and the introducing part and the temperature sensor are located at an internal face side of the external member.

7. The image forming apparatus according to claim 6, wherein the temperature sensor is located in the second duct arranged from the introducing part side toward a predetermined direction.

8. The image forming apparatus according to claim 6 further comprising:

a development device supplying a toner to the image carrier; and a cleaning device collecting the toner from the image carrier, wherein the controlling part controls the development device to supply a predetermined amount of the toner from the development device to the image carrier and to collect the supplied toner by the cleaning device, when the dew condensation avoiding operation is carried out.

9. The image forming apparatus according to claim 6 further comprising:

a driving part rotating the image carrier and the charging member; and a fixing device including a fixing member fixing a toner image on a recording medium and a heat source heating the fixing member, wherein the controlling part controls the heat source to heat the fixing member and to rotate the image carrier and the charging member by the driving part, when the dew condensation avoiding operation is carried out.

10. The image forming apparatus according to claim 9, wherein the introducing part is a fan capable of rotating in forward and reverse directions, and the controlling part controls the fan to change rotation from a reverse direction to a forward direction to introduce air from outside the apparatus main body, when the dew condensation avoiding operation is carried out.

11. The image forming apparatus according to claim 6, wherein the apparatus main body includes the external member covering at least a part of the image forming part.

12. The image forming apparatus according to claim 11, wherein the external member includes a ventilation port composed of a plurality of louvers and the introducing part is located inside the ventilation port.

* * * * *